US010793314B2

(12) United States Patent
Straszewski

(10) Patent No.: US 10,793,314 B2
(45) Date of Patent: Oct. 6, 2020

(54) FOLDABLE PIZZA BOX AND METHOD

(71) Applicant: Darian Straszewski, Owasso, OK (US)

(72) Inventor: Darian Straszewski, Owasso, OK (US)

( * ) Notice: Subject to any disclaimer, the term of this patent is extended or adjusted under 35 U.S.C. 154(b) by 0 days.

(21) Appl. No.: 16/188,440

(22) Filed: Nov. 13, 2018

(65) Prior Publication Data

US 2019/0375536 A1 Dec. 12, 2019

Related U.S. Application Data

(60) Provisional application No. 62/683,402, filed on Jun. 11, 2018.

(51) Int. Cl.

| | |
|---|---|
| ***B65D 85/36*** | (2006.01) |
| ***B65D 5/355*** | (2006.01) |
| ***B65D 5/30*** | (2006.01) |
| ***B31B 50/26*** | (2017.01) |
| *B31B 120/30* | (2017.01) |
| *B31B 50/73* | (2017.01) |
| *B31B 120/10* | (2017.01) |
| *B31B 110/35* | (2017.01) |
| *B31B 50/20* | (2017.01) |

(52) U.S. Cl.

CPC ..... *B65D 5/0005* (2013.01); *B31B 50/26* (2017.08); *B65D 5/302* (2013.01); *B65D 85/36* (2013.01); *B31B 50/20* (2017.08); *B31B 50/734* (2017.08); *B31B 2110/35* (2017.08); *B31B 2120/102* (2017.08); *B31B 2120/30* (2017.08); *B31B 2241/00* (2013.01); *B65D 2585/366* (2013.01)

(58) Field of Classification Search

CPC ... B65D 2585/366; B65D 5/42; B65D 5/4266
USPC ..... 229/902–906, 117.01, 930
See application file for complete search history.

(56) References Cited

U.S. PATENT DOCUMENTS

| | | | | |
|---|---|---|---|---|
| 5,209,392 A * | 5/1993 | Anatro | B65D 5/22 | 229/117.01 |
| 5,305,949 A * | 4/1994 | Linden | B65D 5/42 | 229/117.01 |
| 5,375,761 A | 12/1994 | Sullivan et al. | | |
| 6,375,066 B1 * | 4/2002 | Ritter | B65D 5/0005 | 229/101.2 |
| 6,915,948 B2 * | 7/2005 | George | B65D 5/54 | 229/117.01 |
| 8,690,043 B2 * | 4/2014 | Holch | B65D 5/0005 | 229/101.2 |

(Continued)

*Primary Examiner* — Nathan J Newhouse
*Assistant Examiner* — Phillip D Schmidt
(74) *Attorney, Agent, or Firm* — Boudwin Intellectual Property; Daniel Boudwin

(57) ABSTRACT

A foldable pizza box and method of preparing the foldable pizza box for disposal. The foldable pizza box includes a plurality of perforations placed on several surfaces thereof, bisecting the foldable pizza box into two symmetrical halves and imparting flexibility to the foldable pizza box along the perforations. The foldable pizza box includes triangular punch-outs, formed by perforations, that add additional flexibility to the foldable pizza box when displaced or removed. The foldable pizza box may be easily folded along the perforations, thereby making the foldable pizza box more compact. After folding the foldable pizza box, the foldable pizza box may be easily disposed in a waste or recycling receptacle.

16 Claims, 2 Drawing Sheets

(56) References Cited

U.S. PATENT DOCUMENTS

| | | | | |
|---|---|---|---|---|
| 8,919,635 | B1 * | 12/2014 | Biagioni | B65D 5/6664 206/172 |
| 2007/0267471 | A1 | 11/2007 | Falana | |
| 2008/0006679 | A1 | 1/2008 | Volz et al. | |
| 2009/0057379 | A1 * | 3/2009 | Schulhof | B65D 5/0254 229/75 |
| 2013/0344211 | A1 | 12/2013 | Hemsley | |

* cited by examiner

FOLDABLE PIZZA BOX AND METHOD

CROSS REFERENCE TO RELATED APPLICATIONS

This application claims priority under 35 U.S.C. § 119(e) to U.S. Provisional Application No. 62/683,402 filed on Jun. 11, 2018. The above identified patent application is incorporated by reference herein in its entirety to provide continuity of disclosure.

BACKGROUND OF THE INVENTION

Pizza is a popular food choice among many consumers, but disposal of cardboard boxes used to deliver pizza is often difficult due to the large size and high rigidity of the cardboard pizza box. Standard receptacles for trash and recycling disposal are often too small or narrow to retain a standard pizza box therein. Many consumers prefer a standard receptacle having a smaller form factor, and these consumers would benefit if their pizza were delivered in a box that can easily be disposed in a standard receptacle having a smaller form factor.

Therefore, there is a need in the art for a foldable pizza box and method of folding the pizza box in preparation for disposal of the foldable pizza box. The present invention addresses this unmet need.

FIELD OF THE INVENTION

The present invention relates to a foldable pizza box and a method of preparing the foldable pizza box for disposal.

Devices have been disclosed in the art that relate to pizza boxes. These include devices that have been patented and published in patent application publications. These devices are often difficult to use. In view of the devices disclosed in the art, it is submitted that there is a need in the art for an improvement to existing pizza boxes. In view of the present disclosure, it is submitted that the present invention substantially diverges in structural and functional elements from devices in the art, and the instant invention substantially fulfills an unmet need in the art.

SUMMARY OF THE INVENTION

In view of the disadvantages inherent in the known types of pizza boxes in the art, the present invention provides a foldable pizza box, wherein the same can be utilized for facilitating disposal of the foldable pizza box after removing the pizza from the foldable pizza box.

It is therefore an object of the present invention to provide a foldable pizza box.

Another object of the present invention is to provide a method of preparing a foldable pizza box for disposal.

Another object of the present invention is to provide a foldable pizza box that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
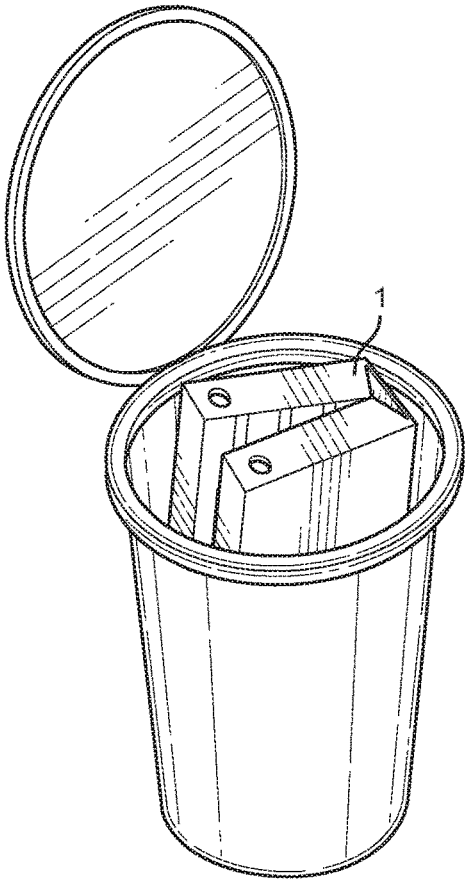
FIG. 1 depicts a perspective view of an exemplary foldable pizza box that has been prepared for disposal before disposing of the foldable pizza box in a standard size receptacle.

Reference is made herein to the attached drawings. Like reference numerals are used throughout the drawings to depict like or similar elements of the invention. The figures are intended for representative purposes only and should not be considered limiting in any respect.

In one aspect, the invention provides a foldable pizza box, comprising two pluralities of linearly arranged perforations bisecting a rectangular bottom wall and a rectangular top wall thereof, as well as two removable triangular pieces each defined by a triangular pattern of a plurality of perforations placed on a bottom forward rectangular sidewall and a bottom rearward rectangular sidewall thereof.

Generally, the perforations are made in, and the foldable pizza box is made of, a material that is otherwise difficult for many to manipulate, such as cardboard. In this manner, the perforations define two triangular pieces that can be displaced or removed by applying a force to each of the triangular pieces. Following displacement or removal of the two triangular pieces, the foldable pizza box is folded about the two pluralities of linearly arranged perforations, thereby compacting the pizza box and preparing it for disposal. The two triangular pieces line up when the box is assembled, and the pizza box is folded such that an angle, of a left side and a right side of the foldable pizza box, adjacent to a side of a hole produced by displacing or removing the triangular pieces, is decreased. This is the path of least resistance for folding the foldable pizza box, as would be understood by a user.

Reference is now made to the drawings, which depict one or more exemplary embodiments of the invention.

Referring now to FIG. 1, there is depicted a perspective view of an exemplary foldable pizza box that has been prepared for disposal before disposing of the foldable pizza box in a standard size receptacle. A goal of the present invention is to provide a foldable pizza box 1, and method of preparing the foldable pizza box 1 for disposal, such that the foldable pizza box 1 may be easily and manually compacted by the user. In a folded configuration, the foldable pizza box 1 occupies a lesser form factor and is more compact in shape, thereby aiding disposal of the foldable pizza box 1. In the shown embodiment, a foldable pizza box 1 has been folded to form a more compact shape and has been placed in a standard receptacle.

Figure 2:
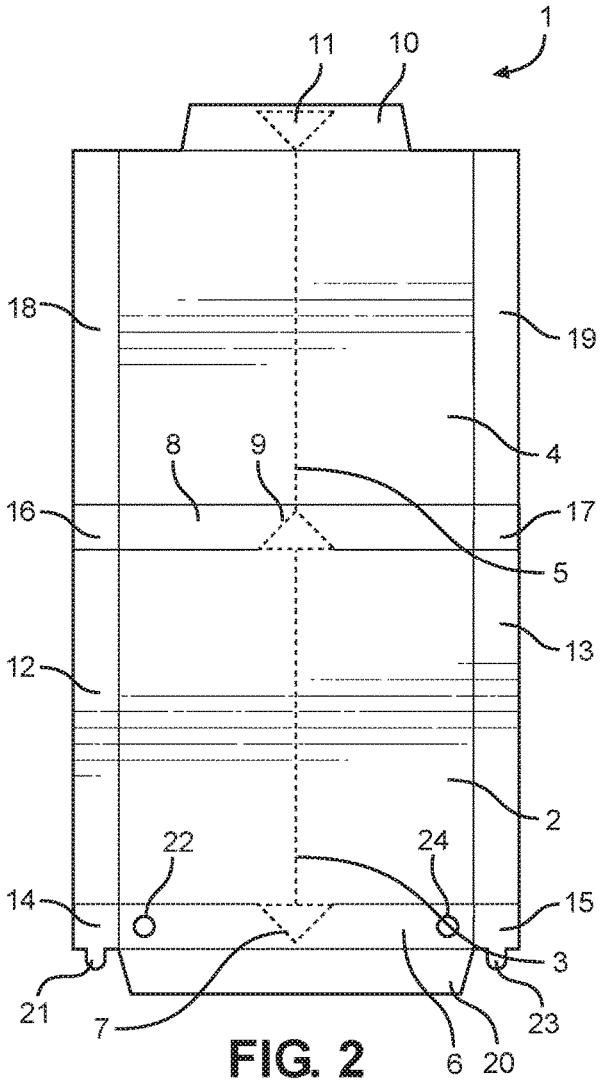
FIG. 2 depicts an elevated view of the exemplary foldable pizza box in an unassembled state.
Figure 5:
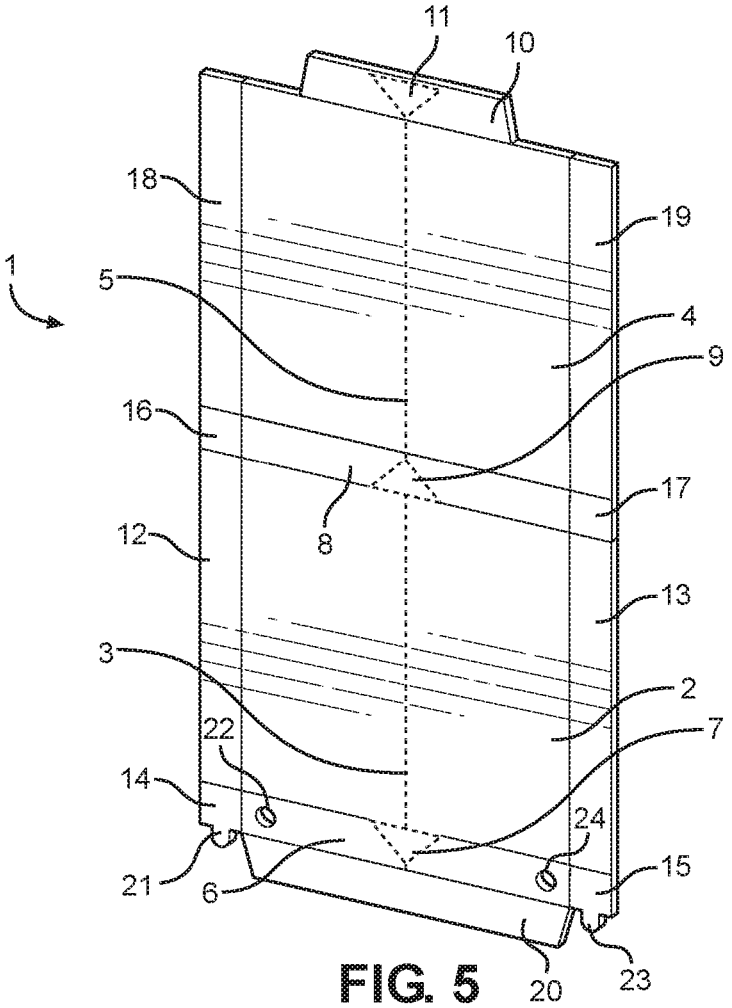
FIG. 5 depicts a perspective view of the exemplary foldable pizza box in an unassembled state.

Referring now to FIGS. 2 and 5, there are depicted an elevated view and a perspective view of the exemplary foldable pizza box in an unassembled state, respectively. The foldable pizza box 1 is in an unassembled state to emphasize components needed to make and use the present invention. The foldable pizza box 1 includes a rectangular bottom wall 2 flexibly connected to a bottom left rectangular sidewall 12 by a left edge thereon, flexibly connected to a bottom right rectangular sidewall 13 by a right edge thereon, flexibly connected to a bottom forward rectangular sidewall 6 by a forward edge thereon, and flexibly connected to a bottom rearward rectangular sidewall 8 by a rearward edge thereon. The foldable pizza box 1 includes a rectangular top wall 4 flexibly connected to a top left rectangular sidewall 18 by a left edge thereon, flexibly connected to a top right rectangular sidewall 19 by a right edge thereon, flexibly connected to a top forward sidewall 10 by a forward edge thereon, and flexibly connected to the bottom rearward rectangular sidewall 8 by a rearward edge thereon. Particularly, the rectangular bottom wall 2 and the rectangular top wall 4 each comprises a plurality of linearly arranged perforations bisecting the rectangular bottom wall (3) and bisecting the rectangular top wall (5), such that each plurality of linearly arranged perforations (3, 5) is perpendicular to the rectangular bottom wall rearward edge.

Figure 3:
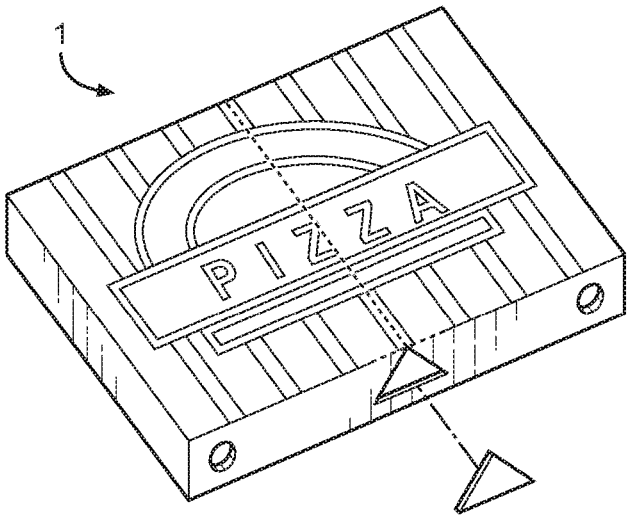
FIG. 3 depicts a perspective view of the exemplary foldable pizza box in an assembled state, wherein a triangular piece has been removed from the foldable pizza box in preparation for folding the foldable pizza box.
Figure 4:
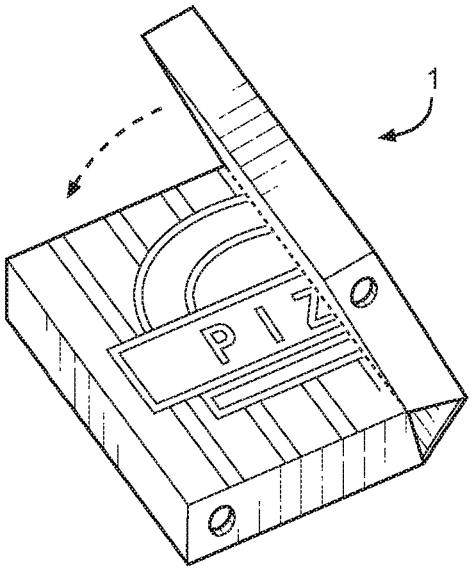
FIG. 4 depicts a perspective view of the exemplary foldable pizza box in an assembled state, wherein a triangular piece has been removed from the foldable pizza box in preparation for folding the foldable pizza box, and wherein the pizza box has been partially folded in preparation for disposal of the foldable pizza box.

The bottom forward rectangular sidewall 6 comprises a removable triangular piece 7 defined by a triangular pattern of a plurality of perforations, and the bottom rearward rectangular sidewall 8 comprises a removable triangular piece 9 defined by a triangular pattern of a plurality of perforations. The bottom forward rectangular sidewall removable triangular piece 7 aligns with the bottom rearward rectangular sidewall removable triangular piece 9 when the foldable pizza box 1 is assembled. In this manner, displacement or removal of the triangular pieces 7 and 9 provides an easily foldable structure that is ready for preparation for disposal in a receptacle. In some embodiments, a vertex of the bottom forward rectangular sidewall removable triangular piece 7, and a vertex of the bottom rearward rectangular sidewall removable triangular piece 9 each is oriented in a direction of the rectangular bottom wall 2 when the foldable pizza box 1 is assembled. In this manner, displacement or removal of the triangular pieces 7 and 9 provides an easily foldable structure that is ready for preparation for disposal in a receptacle by folding a left side and a right side of the foldable pizza box upward, as depicted in FIGS. 3 and 4. Generally, the foldable pizza box 1 is configured to be folded along each of the pluralities of linearly arranged perforations (3, 5) to prepare the foldable pizza box 1 for disposal, without having to disassemble the foldable pizza box 1 after assembly of the foldable pizza box 1.

In some embodiments, the bottom left rectangular sidewall 12 is flexibly connected to a bottom left rectangular sidewall corner 16, and the bottom right rectangular sidewall 13 is flexibly connected to a bottom right rectangular sidewall corner 17. In these embodiments, the bottom left rectangular sidewall corner 16 is adjacent to, but is not connected to, the top left rectangular sidewall 18. In addition, in these embodiments, the bottom right rectangular sidewall corner 17 is adjacent to, but is not connected to, the top right rectangular sidewall 19. In these embodiments, the bottom left rectangular sidewall corner 16 is adjacent to, but is not connected to, the bottom rearward rectangular sidewall 8. In addition, in these embodiments, the bottom right rectangular sidewall corner 17 is adjacent to, but is not connected to, the bottom rearward rectangular sidewall 8. As such, during assembly of the foldable pizza box 1, the corners 16 and 17 fold inward. In this manner, the foldable pizza box 1 has additional structural support to remain in a closed position during delivery of a pizza contained therein.

In some embodiments, the bottom forward rectangular sidewall 6 is flexibly connected to a bottom forward rectangular sidewall extension 20 by a forward edge thereon. The bottom forward rectangular sidewall extension 20 is folded over the bottom forward rectangular sidewall 6 during assembly of the foldable pizza box 1, such that the bottom forward rectangular sidewall extension 20 is mostly flush against and parallel with the bottom forward rectangular sidewall 6, as would be understood by a person having ordinary skill in the art. In this manner, the foldable pizza box 1 has additional structural support to remain in a closed position during delivery of a pizza contained therein. In some embodiments, the bottom forward rectangular sidewall extension 20 is tapered to preserve material during construction of the foldable pizza box, and to facilitate insertion of the bottom forward rectangular sidewall extension 20 into the foldable pizza box during assembly. In some embodiments, the bottom forward rectangular sidewall extension 20 includes a removable triangular piece thereon, to further facilitate folding and disposal of the foldable pizza box 1.

In some embodiments, the top forward sidewall 10 has a width that is less than a width of the rectangular top wall 4, and the top forward sidewall 10 is tapered to preserve material during construction of the foldable pizza box, and to facilitate assembly of the foldable pizza box 1.

In some embodiments, the bottom left rectangular sidewall 12 is flexibly connected to a bottom forward left insertion member 14 by a forward edge thereon, and the bottom right rectangular sidewall 13 is flexibly connected to a bottom forward right insertion member 15 by a forward edge. The bottom forward rectangular sidewall 6 comprises a bottom forward left receiving hole 22 and a bottom forward right receiving hole 24, and the bottom forward left receiving hole 22 is configured to receive and secure a tab 21 of the bottom forward left insertion member 14 when the foldable pizza box 1 is assembled, and the bottom forward right receiving hole 24 is configured to receive and secure a tab 23 of the bottom forward right insertion member 15 when the foldable pizza box 1 is assembled. In this manner, the foldable pizza box 1 has additional structural support to remain in an assembled configuration, and in a closed position, during delivery of a pizza contained therein.

In some embodiments, the top forward sidewall 10 comprises a removable triangular piece 11 defined by a triangular pattern of a plurality of perforations, and the top forward sidewall removable triangular piece 11 aligns with the bottom forward rectangular sidewall removable triangular piece 7 and the bottom rearward rectangular sidewall removable triangular piece 9 when the foldable pizza box is assembled. In this manner, displacement or removal of the triangular pieces 7, 9, and 11 provides an easily foldable structure that is ready for preparation for disposal in a receptacle.

In some embodiments, a vertex of each of the bottom forward rectangular sidewall removable triangular piece 7, the bottom rearward rectangular sidewall removable triangular piece 9, and the top forward sidewall removable triangular piece 11 each is oriented in a direction of the rectangular bottom wall when the foldable pizza box is assembled. In this manner, displacement or removal of the triangular pieces 7, 9, and 11 provide an easily foldable structure that is ready for preparation for disposal in a receptacle by folding the left and the right side upward, as depicted in FIGS. 3 and 4.

Referring now to FIG. 3, there is depicted a perspective view of the exemplary foldable pizza box in an assembled state, wherein a triangular piece has been removed from the foldable pizza box in preparation for folding the foldable pizza box. Generally, the foldable pizza box 1 is a rectangular cuboid, sized and configured to securely hold the pizza therein. In the shown embodiment, a triangular piece is depicted as being completely removed from the foldable pizza box 1 in preparation for folding the foldable pizza box 1, in order to emphasize and clearly communicate this feature of the invention. However, it is contemplated that each triangular piece disclosed herein is designed to be wholly displaced (e.g., completely removed, as shown) or partially displaced (e.g., still partially attached, but substantially removed to facilitate folding of the foldable pizza box 1). It should be noted that if a triangular piece is only partially displaced, it is generally desirable that a structural integrity of a portion of the foldable pizza box 1 on which the triangular piece is still partially attached is reduced, thereby facilitating folding and disposing the foldable pizza box 1 according to the present invention.

Referring now to FIG. 4, there is depicted a perspective view of the exemplary foldable pizza box in an assembled state, wherein a triangular piece has been removed from the foldable pizza box in preparation for folding the foldable pizza box, and wherein the pizza box has been partially folded in preparation for disposal of the foldable pizza box. The dotted curved arrow depicts a direction of the folding of the foldable pizza box 1. In this manner, a form factor of the foldable pizza box 1 is reduced to compact the foldable pizza box for disposal.

Referring now to FIGS. 1-5, a method is provided for preparing the foldable pizza box 1 for disposal. The method for preparing the foldable pizza box 1 for disposal comprises assembling the foldable pizza box 1, displacing or removing a bottom forward rectangular sidewall removable triangular piece 7 of the foldable pizza box 1, displacing or removing a bottom rearward rectangular sidewall removable triangular piece 9, folding the foldable pizza box 1 along a plurality of linearly arranged perforations 3 bisecting a rectangular bottom wall 2 of the foldable pizza box 1, and folding the foldable pizza box 1 along a plurality of linearly arranged perforations 5 bisecting a rectangular top wall 4 of the foldable pizza box 1. In this manner, the form factor occupied by the foldable pizza box 1 is decreased before disposing the foldable pizza box 1 in a receptacle, for example, as depicted in FIG. 1 and described elsewhere herein.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the instant invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A foldable pizza box, comprising:

a rectangular bottom wall flexibly connected to each of a bottom left rectangular sidewall by a left edge thereon, a bottom right rectangular sidewall by a right edge thereon, a bottom forward rectangular sidewall by a forward edge thereon, and a bottom rearward rectangular sidewall by a rearward edge thereon;

a rectangular top wall flexibly connected to each of a top left rectangular sidewall by a left edge thereon, a top right rectangular sidewall by a right edge thereon, a top forward sidewall by a forward edge thereon, and the bottom rearward rectangular sidewall by a rearward edge thereon;

wherein the rectangular bottom wall and the rectangular top wall each comprises a plurality of linearly arranged perforations bisecting the rectangular bottom wall and bisecting the rectangular top wall, wherein each plurality of linearly arranged perforations is perpendicular to the rectangular bottom wall rearward edge;

wherein the bottom forward rectangular sidewall comprises a removable triangular piece defined by a triangular pattern of a plurality of perforations, and wherein the bottom rearward rectangular sidewall comprises a removable triangular piece defined by a triangular pattern of a plurality of perforations;

wherein a first vertex of each of the bottom forward rectangular sidewall removable triangular piece and the bottom rearward rectangular sidewall removable triangular piece is disposed adjacent the rectangular top wall;

wherein a second vertex and a third vertex of each of the bottom forward rectangular sidewall removable triangular piece and the bottom rearward rectangular sidewall removable triangular piece is disposed adjacent to the rectangular bottom wall;

wherein a side of each of the bottom forward rectangular sidewall removable triangular piece and the bottom rearward rectangular sidewall removable triangular piece defined between the second vertex and the third vertex is parallel to the rectangular bottom wall;

wherein the bottom forward rectangular sidewall removable triangular piece aligns with the bottom rearward rectangular sidewall removable triangular piece when the foldable pizza box is assembled.

2. The foldable pizza box of claim 1, wherein the foldable pizza box is configured to be folded along each of the pluralities of linearly arranged perforations to prepare the foldable pizza box for disposal.

3. The foldable pizza box of claim 1, wherein the top forward sidewall has a width that is less than a width of the rectangular top wall, wherein the top forward sidewall is tapered.

4. The foldable pizza box of claim 1, wherein the bottom forward rectangular sidewall is flexibly connected to a bottom forward rectangular sidewall extension by a forward edge thereon.

5. The foldable pizza box of claim 4, wherein the bottom forward rectangular sidewall extension is tapered.

6. The foldable pizza box of claim 1, wherein the bottom left rectangular sidewall is flexibly connected to a bottom forward left insertion member by a forward edge thereon, wherein the bottom right rectangular sidewall is flexibly connected to a bottom forward right insertion member by a forward edge thereon.

7. The foldable pizza box of claim 6, wherein the bottom forward rectangular sidewall comprises a bottom forward left receiving hole and a bottom forward right receiving hole, wherein the bottom forward left receiving hole is configured to receive and secure the bottom forward left insertion member when the foldable pizza box is assembled, wherein the bottom forward right receiving hole is configured to receive an secure the bottom forward right insertion member when the foldable pizza box is assembled.

8. The foldable pizza box of claim 1, wherein the top forward sidewall comprises a removable triangular piece defined by a triangular pattern of a plurality of perforations, wherein the top forward sidewall removable triangular piece aligns with the bottom forward rectangular sidewall removable triangular piece and the bottom rearward rectangular sidewall removable triangular piece when the foldable pizza box is assembled.

9. A method of preparing a foldable pizza box for disposal, comprising:

assembling the foldable pizza box, displacing a bottom forward rectangular sidewall removable triangular piece of the foldable pizza box, displacing a bottom rearward rectangular sidewall removable triangular piece, folding the foldable pizza box along a plurality of linearly arranged perforations bisecting a rectangular bottom wall of the foldable pizza box, and folding the foldable pizza box along a plurality of linearly arranged perforations bisecting a rectangular top wall of the foldable pizza box;

wherein the foldable pizza box comprises:

the rectangular bottom wall flexibly connected to each of a bottom left rectangular sidewall by a left edge thereon, a bottom right rectangular sidewall by a right edge thereon, a bottom forward rectangular sidewall by a forward edge thereon, and a bottom rearward rectangular sidewall by a rearward edge thereon;

a rectangular top wall flexibly connected to each of a top left rectangular sidewall by a left edge thereon, a top right rectangular sidewall by a right edge thereon, a top forward sidewall by a forward edge thereon, and the bottom rearward rectangular sidewall by a rearward edge thereon;

wherein the rectangular bottom wall and the rectangular top wall each comprises the plurality of linearly arranged perforations bisecting the rectangular bottom wall and bisecting the rectangular top wall, wherein each plurality of linearly arranged perforations is perpendicular to the rectangular bottom wall rearward edge;

wherein the bottom forward rectangular sidewall comprises the removable triangular piece defined by a rectangular pattern of a plurality of perforations, and wherein the bottom rearward rectangular sidewall comprises the removable triangular piece defined by a triangular pattern of a plurality of perforations;

wherein a first vertex of each of the bottom forward rectangular sidewall removable triangular piece and the bottom rearward rectangular sidewall removable triangular piece is disposed adjacent the rectangular top wall;

wherein a second vertex and a third vertex of each of the bottom forward rectangular sidewall removable triangular piece and the bottom rearward rectangular sidewall removable triangular piece is disposed adjacent to the rectangular bottom wall;

wherein a side of each of the bottom forward rectangular sidewall removable triangular piece and the bottom rearward rectangular sidewall removable triangular piece defined between the second vertex and the third vertex is parallel to the rectangular bottom wall;

wherein the bottom forward rectangular sidewall removable triangular piece aligns with the bottom rearward rectangular sidewall removable triangular piece when the foldable pizza box is assembled.

10. The method of claim 9, wherein the bottom forward rectangular sidewall removable triangular piece and the bottom rearward rectangular sidewall removable triangular piece are completely removed from the foldable pizza box before folding the foldable pizza box.

11. The method of claim 9, wherein the top forward sidewall has a width that is less than a width of the rectangular top wall, wherein the top forward sidewall is tapered.

12. The method of claim 9, wherein the bottom forward rectangular sidewall is flexibly connected to a bottom forward rectangular sidewall extension by a forward edge thereon.

13. The method of claim 12, wherein the bottom forward rectangular sidewall extension is tapered.

14. The method of claim 9, wherein the bottom left rectangular sidewall is flexibly connected to a bottom forward left insertion member by a forward edge thereon;

wherein the bottom right rectangular sidewall is flexibly connected to a bottom forward right insertion member by a forward edge thereon.

15. The method of claim 14, wherein the bottom forward rectangular sidewall comprises a bottom forward left receiving hole and a bottom forward right receiving hole, wherein the bottom forward left receiving hole is configured to receive and secure the bottom forward left insertion member when the foldable pizza box is assembled, wherein the bottom forward right receiving hole is configured to receive and secure the bottom forward right insertion member when the foldable pizza box is assembled.

16. The method of claim 9, wherein the top forward sidewall comprises a removable triangular piece defined by a triangular pattern of a plurality of perforations, wherein the top forward sidewall removable triangular piece aligns with the bottom forward rectangular sidewall removable triangular piece and the bottom rearward rectangular sidewall removable triangular piece when the foldable pizza box is assembled.

* * * * *